US006206719B1

(12) United States Patent
Tsunezawa et al.

(10) Patent No.: US 6,206,719 B1
(45) Date of Patent: Mar. 27, 2001

(54) ELECTRIC COMPONENT UNIT WITH LEAD WIRE CONNECTION TERMINAL FITMENT

(75) Inventors: Ichiro Tsunezawa; Kazufumi Daimon, both of Osawano-machi (JP)

(73) Assignee: Hokuriku Electric Industry Co., Ltd., Toyama Pref. (JP)

( * ) Notice: Subject to any disclaimer, the term of this patent is extended or adjusted under 35 U.S.C. 154(b) by 0 days.

(21) Appl. No.: 09/317,276

(22) Filed: May 24, 1999

(30) Foreign Application Priority Data

May 25, 1998 (JP) ..... 10-142756

(51) Int. Cl.[7] ..... H01R 4/26
(52) U.S. Cl. ..... 439/395; 439/733.1
(58) Field of Search ..... 439/395, 733.1, 439/400, 387, 744, 443, 444

(56) References Cited

U.S. PATENT DOCUMENTS 4,288,141 * 9/1981 Leather ..... 439/395
4,781,615 * 11/1988 Davis et al. ..... 439/395
5,376,018 * 12/1994 Davis et al. ..... 439/405

FOREIGN PATENT DOCUMENTS

204900/1992 7/1992 (JP) .

* cited by examiner

*Primary Examiner*—Lincoln Donovan
*Assistant Examiner*—Brian S. Webb
(74) *Attorney, Agent, or Firm*—Rankin, Hill, Porter & Clark LLP

(57) ABSTRACT

An electric component unit including a lead wire connection terminal fitment which is capable of being readily fixed on a terminal fitment mounting section of a casing and facilitating connection of a lead wire thereto is provided. A terminal fitment fit section of a terminal fitment mounting section of a casing is formed with a pair of terminal mounting fit grooves, in which a fitted section of a lead wire connection terminal fitment is fitted. The lead wire connection terminal fitment is made of a metal sheet of 0.7 mm in thickness by machining. A terminal section of the terminal fitment is formed into a width equal to or above a thickness of the metal sheet. The lead wire connection terminal fitment also includes a lead wire connection section, which is provided with a lead wire insertion opening which permits a core of a lead wire to be inserted therethrough and a lead wire press-fit groove in which the core of the lead wire displaced from the lead wire insertion opening is press-fitted.

4 Claims, 5 Drawing Sheets

ELECTRIC COMPONENT UNIT WITH LEAD WIRE CONNECTION TERMINAL FITMENT

BACKGROUND OF THE INVENTION

This invention relates to an electric component unit with a lead wire connection terminal fitment, and more particularly to an electric component unit such as a high-voltage variable resistor or the like which includes a casing provided with a terminal fitment mounting section and has a lead wire connection terminal fitment formed by subjecting a metal sheet to machining and mounted on the terminal fitment mounting section by means of a fit structure and such a lead wire connection terminal fitment.

An electric component unit such as a high-voltage variable resistor or the like which is called a focus pack and combined with a fly-back transformer generally includes a casing, which often has lead wire connection terminal fitments fixed thereon for connecting lead wires led out of electric components received in the casing thereto. Such a lead wire connection terminal fitment is generally formed either by bending a rod-like or wire-like conductor or by subjecting a metal plate or sheet to machining. The former process causes the wire connection terminal fitment formed to be rotated about a central axis thereof when it is formed into a simple configuration, so that it is highly difficult to fix the terminal fitment on a terminal fitment mounting section of the casing only by means of the fit structure. On the contrary, the latter process not only permits the terminal fitment formed to be fixed on the terminal fitment mounting section of the casing merely by means of the fit structure, but facilitates mass production of the lead wire connection terminal fitment.

In Japanese Patent Application No. 204900/1992 assigned to the assignee, a lead wire connection terminal fitment is disclosed which is formed by subjecting a metal sheet to machining. The lead wire connection terminal fitment disclosed is made of a metal sheet as thin as about 0.3 mm. The metal sheet is thus reduced in thickness, therefore, a fitted section of the lead wire connection terminal fitment which is to be fitted on a fitment terminal mounting section of a casing and a terminal section thereof are increased in width, resulting in being subject to bending for reinforcement. Also, the lead wire connection terminal fitment disclosed is so constructed that connection of a lead wire thereto is carried out by winding a core of a lead wire on a lead wire connection section and then subjecting the core and lead wire connection section to soldering.

Such an electric component unit is generally demanded to be reduced in manufacturing cost, price and the number of steps in the manufacturing as in other electric component units. In order to address to such demands, automated assembling of the electric component unit and a reduction in the number of times of soldering in manufacturing thereof have been generally employed. However, the conventional lead wire connection terminal fitment formed by subjecting a metal sheet to machining substantially fails to automate lead wire connection operation and ensure lead wire connection without any welding. Also, the lead wire connection terminal fitment thus formed fails to permit a terminal section to be formed into a thin configuration like a pin terminal. Thus, the lead wire connection terminal fitment formed by machining of a metal sheet cannot be applied to a structure wherein terminal sections of all terminal fitments are inserted into through-holes of a circuit board and connection of terminal sections of all terminal fitments to a female connector.

SUMMARY OF THE INVENTION

The present invention has been made in view of the foregoing disadvantages of the prior art.

Accordingly, it is an object of the present invention to provide an electric component unit which is capable of solving the above-described problems of the prior art.

It is another object of the present invention to provide a lead wire connection terminal fitment which is capable of facilitating connection of a lead wire thereto and permitting a terminal section thereof to be formed into a thin configuration like a pin terminal.

It is a further object of the present invention to provide an electric component unit including such lead wire connection terminal fitments attaining the above-described object.

It is still another object of the present invention to provide an electric component unit which is capable of attaining fixing of a lead wire connection terminal fitment thereto by inserting the lead wire connection terminal fitment from an outside of a casing into a terminal mounting fit groove formed on a terminal fitment mounting section of the casing and facilitating connection of a lead wire thereto.

In accordance with one aspect of the present invention, an electric component unit is provided. The electric component unit is so constructed that a fitted section of a lead wire connection terminal fitment is fitted in a terminal fitment fit section provided at a terminal fitment mounting section of a casing made of an insulating resin material. The number of lead wire connection terminal fitments to be arranged may be selected as desired. The lead wire connection terminal fitment is made by subjecting a metal sheet to machining. The lead wire connection terminal fitment includes a lead wire connection section which is formed integrally with the fitted section and to which a lead wire extending from an electric component received in the casing is connected, as well as a terminal section arranged so as to extend to an outside of the casing and electrically connected to an electric component arranged outside the casing. When the casing is formed on one surface thereof with an opening, the terminal fitment mounting section arranged along one side of the opening of the casing is integrally provided with one or more terminal fitment fit sections. The terminal fitment fit section of the terminal fitment mounting section of the casing is provided with a pair of terminal mounting fit grooves extending toward an inside of the casing from the outside of the casing in which both ends of the fitted section extending in a longitudinal direction thereof are fitted.

The fitted section of the lead wire connection terminal fitment is provided with an engagement, which is engaged with a part of the terminal fitment fit section to prevent the fitted section from being dislocated from each of the terminal mounting fit grooves when the both ends of the fitted section are fittedly inserted into the terminal mounting fit grooves toward the inside of the casing from the outside thereof. The fitted section is provided thereon with stoppers, each of which is engaged with a part of the terminal fitment fit section to firmly position the fitted section when both ends of the fitted section are inserted into the terminal mounting fit grooves toward the inside of the casing from the outside thereof. The lead wire connection section and fitted section of the lead wire connection terminal fitment are connected to each other through a curved section so that a right angle or a nearly right angle may be defined between the lead wire connection section and the fitted section. Such construction enhances mechanical strength of the lead wire connection terminal fitment and prevents removal or dislocation of the fitted section from the terminal mounting fit grooves.

Also, arrangement of the stoppers on the lead wire connection terminal fitment prevents excessive insertion of the fitted section of the lead wire connection terminal fitment into the terminal mounting fit grooves and ensures automatic insertion of the lead wire connection terminal fitment thereinto.

The lead wire connection terminal fitment is made of a metal sheet of 0.7 mm or more in thickness. Such a thickness is two times or more as large as that of a metal sheet used for manufacturing the conventional lead wire connection terminal described above. An excessive increase in thickness of the metal sheet renders processing or machining thereof troublesome and leads to an increase in manufacturing cost thereof, so that an upper limit of the thickness is necessarily set. For example, use of stainless steel for the metal sheet causes a thickness of the metal sheet to be limited up to about 1 $\mu$m in view of workability and economical efficiency. Of course, an upper limit of the thickness of the metal sheet is varied depending on rigidity of the metal sheet and a cost thereof. Use of the metal sheet of 0.7 mm or more in thickness eliminates a necessity of subjecting the fitted section and terminal section of the lead wire connection terminal fitment to machining or bending for reinforcement. This eliminates a necessity of increasing a width of the fitted section and terminal section which is encountered with the prior art. Thus, the present invention permits the terminal section of the lead wire connection terminal section to be formed into a thin configuration like a pin terminal formed by bending a wire-like conductor of a diameter as small as about 0.7 mm.

The terminal section is formed into a width equal to or larger than a thickness of the metal sheet. A decrease in thickness of the metal sheet as compared with a width of the terminal section causes a significance of increasing a thickness of the metal sheet for the purpose of enhancing mechanical strength of the terminal section to be lost. Formation of the terminal section into a thickness and a width substantially equal to each other permits the terminal section to be thinner without deteriorating the mechanical strength. The terminal section thus formed may be inserted into a through-hole of a circuit board and used as a male terminal for a connector as well. The terminal section of the lead wire connection terminal fitment thus formed preferably has four corners formed so as to extend in a direction in which the terminal section extends. In this instance, the corners each are formed so as to be curved in a manner to outwardly protrude. The terminal section of the lead wire connection section is tapered off at a distal end thereof. This permits the terminal section to be formed into substantially the same configuration as the pin terminal, so that it may be handled or operated in substantially the same way as the pin terminal.

The lead wire connection section is formed with a lead wire insertion opening having a width larger than a diameter of a core of the lead wire, as well as a lead wire press-fit groove having a width smaller than the diameter of the core of the lead wire and contiguous to the lead wire insertion opening. Thus, the lead wire is connected to the lead wire connection section while being kept press-fitted in the lead-wire press-fit groove. Such construction permits fixing of the lead wire to the lead wire connection terminal fitment and electrical connection of the lead wire to the terminal fitment to be concurrently attained by merely inserting the core of the lead wire into the lead wire insertion opening and then transferring the lead wire into the lead wire press-fit groove, resulting in readily automatically attaining the fixing and facilitating the connection. In particular, the lead wire press-fit groove may be formed on surfaces thereof opposite to each with ruggedness which is adapted to bite into the core of the lead wire. This ensures more effective fixing and connection of the lead wire. Also, the lead wire insertion opening may be formed so as to be outwardly enlarged. This facilitates insertion of the lead wire into the lead wire insertion opening.

Now, the construction of the present invention which facilitates mounting of the lead wire connection terminal fitment in the terminal fitment fit section and effectively prevents dislocation of the former from the latter will be described. The terminal fitment fit section includes a pair of raised portions arranged in a manner to be spaced from each other at an interval which permits the above-described curved section of the lead wire connection terminal fitment to pass therethrough. The raised portions are formed on inner surfaces thereof opposite to each other with the terminal mounting fit grooves, respectively. Also, the raised portions each are provided at an intermediate portion thereof defined in a longitudinal direction of each of the terminal mounting fit grooves with a dividing groove for dividing each of the terminal mounting fit grooves into two parts. The fitted section of the lead wire connection terminal fitment is integrally formed on each of both ends thereof extending in the longitudinal direction thereof with a projection acting as an engagement. The projections each are formed so as to be increased in an amount of laterally outwardly projecting from both ends of the fitted section as they extend toward the terminal section, resulting in being provided with an inclined surface. The fitted section is formed on each of both ends thereof extending in the longitudinal direction thereof with a recess in a manner to be contiguous to an end of the inclined surface of each of the projections positioned on a side of the lead wire connection section. The dividing grooves each are so formed that an end surface of each of the projections positioned on a side of the terminal section is abutted against a surface of the terminal fitment fit section defining the dividing groove, when the projections each are fitted in each of the dividing grooves and force in a direction toward the outside of the casing from the inside thereof is applied to the lead wire connection terminal fitment. Such construction facilitates mounting of the lead wire connection terminal fitment in the terminal fitment fit section and effectively prevents dislocation of the lead wire connection terminal fitment from the terminal fitment fit section. In such construction, the terminal mounting fit grooves each may be closed at an end thereof facing the inside of the casing with a plug. The fitted section of the lead wire connection terminal fitment may be so constructed that an end thereof defined on a side of the lead wire connection section constitutes a stopper which is abutted against the plugs. Thus, the stopper may be readily constituted by the end of the fitted section on the side of the lead wire connection section without machining such as bending or the like. An increase in thickness of the metal sheet renders bending of the metal sheet in a slight amount highly troublesome. Thus, the stopper provided by the present invention facilitates manufacturing of the lead wire connection terminal fitment.

When the electric component unit of the present invention is embodied in the form of a high-voltage variable resistor, the lead wire connection terminal fitment may be used for connection of a lead wire of a capacitor connected between a capacitor connected to a focus voltage output terminal or an input terminal and the ground.

BRIEF DESCRIPTION OF THE DRAWINGS

These and other objects and many of the attendant advantages of the present invention will be readily appreciated as the same becomes better understood by reference to the following detailed description when considered in connection with the accompanying drawings; wherein.

DETAILED DESCRIPTION OF THE PREFERRED EMBODIMENT

Now, the present invention will be described hereinafter with reference to the accompanying drawings.

Figure 1A:
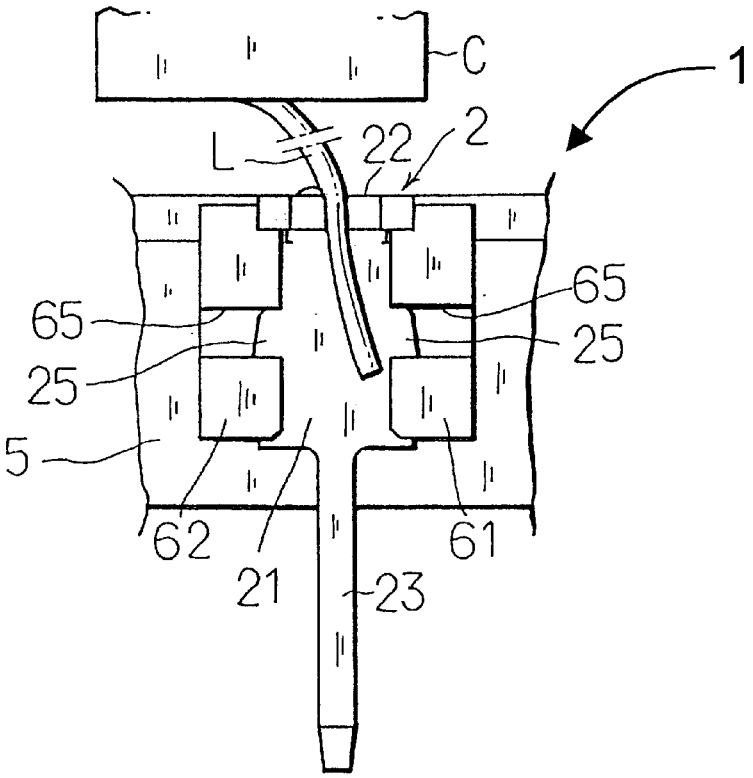
FIG. 1A is an enlarged plan view showing an essential part of a terminal fitment mounting section of a lead wire connection terminal fitment of an electric component unit according to the present invention which is embodied in the form of a high-voltage variable resistor.
Figure 1B:
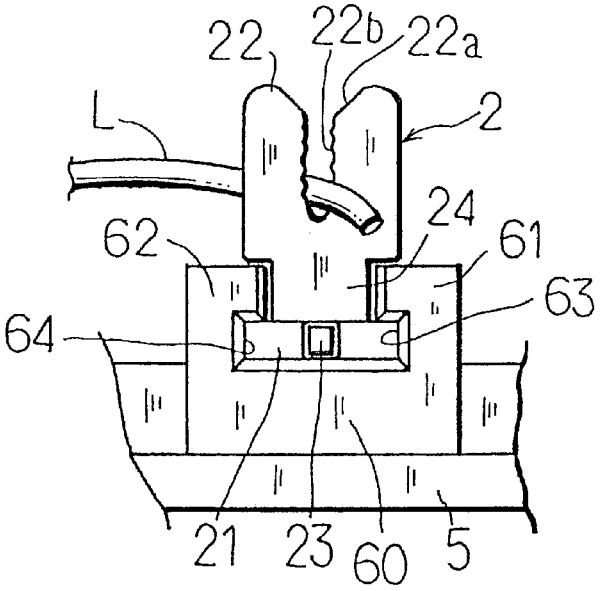
FIG. 1B is an enlarged front elevation view of the essential part of the terminal fitment mounting section of the lead wire connection terminal fitment shown in FIG. 1A.
Figure 2A:
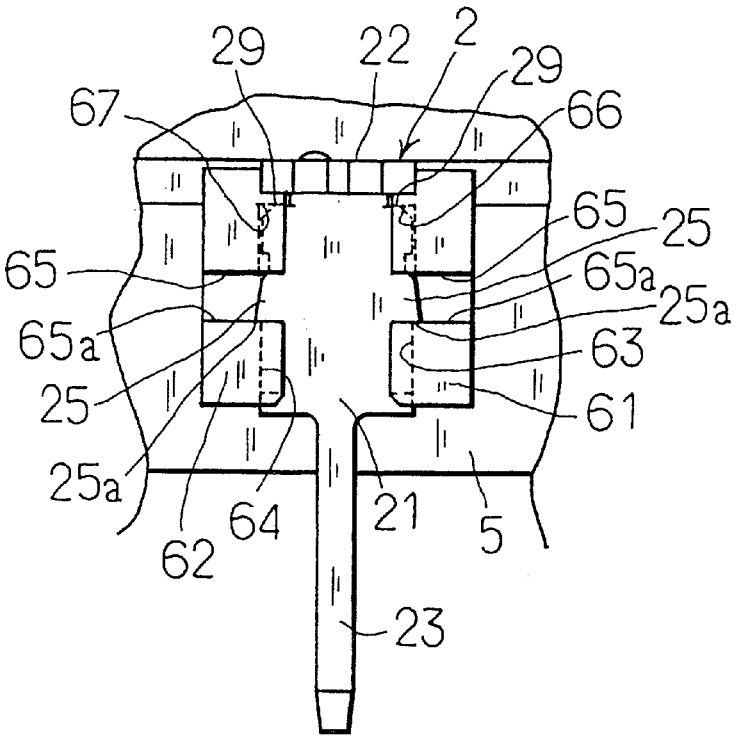
FIG. 2A is an enlarged plan view showing an essential part of the terminal fitment mounting section of the lead wire connection terminal fitment of FIG. 1A which does not have a lead wire connected thereto.
Figure 2B:
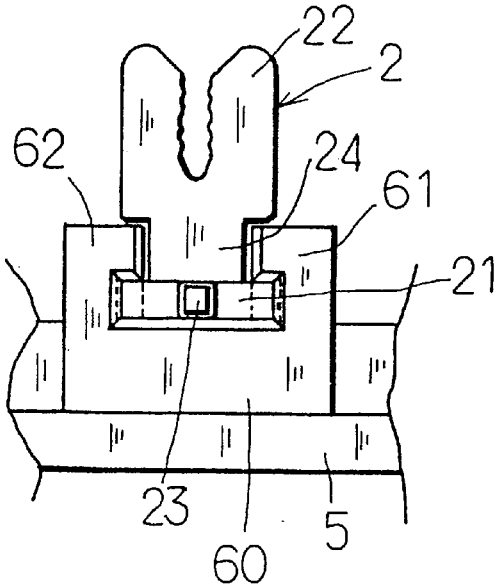
FIG. 2B is an enlarged front elevation view of the essential part of the terminal fitment mounting section shown in FIG. 2A.
Figure 3A:
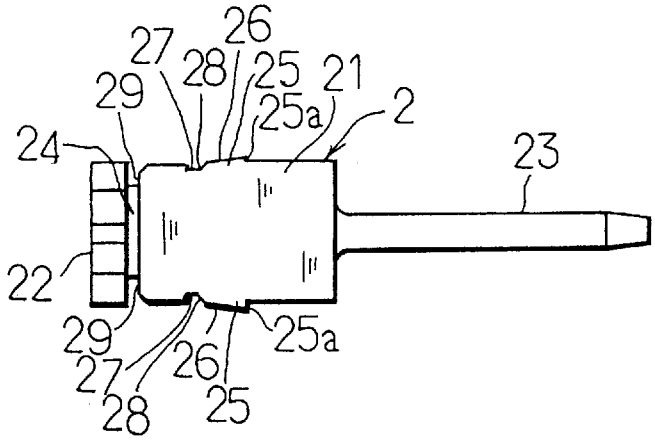
FIG. 3A is a plan view showing a lead wire connection terminal fitment.
Figure 3B:
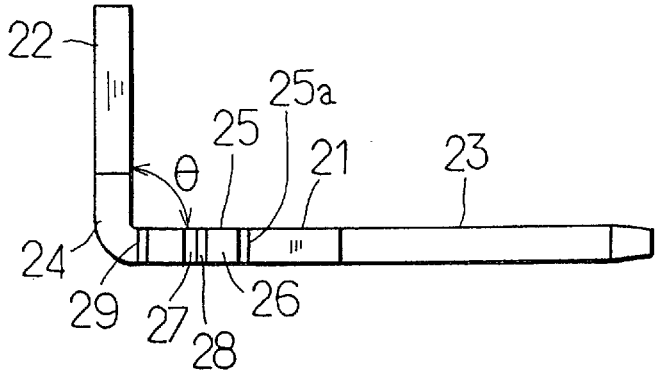
FIG. 3B is a side elevation view of the lead wire connection terminal fitment shown in FIG. 3A.
Figure 3C:
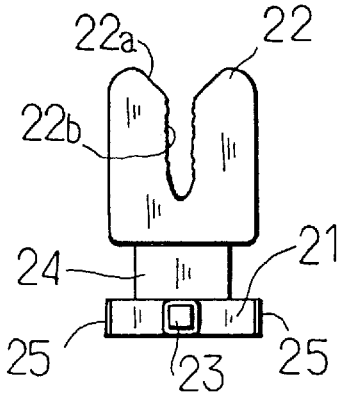
FIG. 3C is a front elevation view of the lead wire connection terminal fitment shown in FIG. 3A.
Figure 4A:
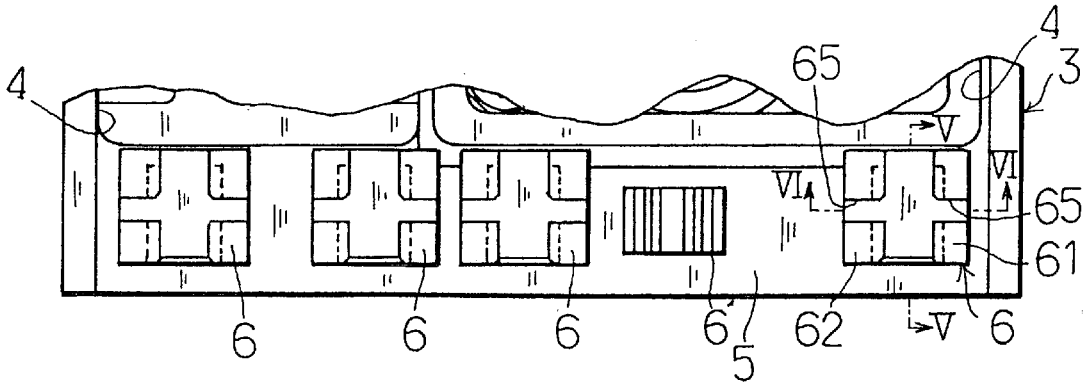
FIG. 4A is a fragmentary enlarged plan view showing a terminal fitment mounting section provided on a rear surface of a resin casing of a high-voltage variable resistor combined with a fly-back transformer.
Figure 4B:
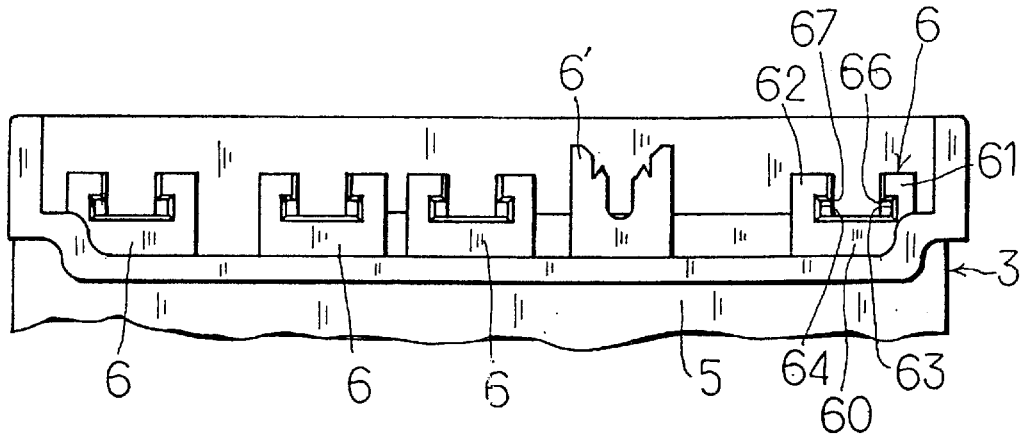
FIG. 4B is elevational view of the terminal fitment mounting section shown in FIG. 4A.

Referring first to FIGS. 1A to 4B, an embodiment of an electric component unit according to the present invention is illustrated, which is embodied in the form of a high-voltage variable resistor; wherein FIGS. 1A and 1B each show an essential part of a terminal fitment mounting section of a lead wire connection terminal fitment 2 of an electric component unit 1 of the illustrated embodiment, FIGS. 2A and 2B each show an essential part of the mounting section of the lead wire connection terminal 2 which does not have a lead wire connected thereto, FIGS. 3A to 3C each show the lead wire connection terminal fitment 2, and FIGS. 4*a* and 4B each show a terminal fitment mounting section provided on a rear surface of a resin casing 3 of a high-voltage variable resistor combined with a fly-back transformer.

The casing 3 shown in FIG. 4 which is made of an insulating resin material is provided on a rear surface thereof or a surface thereof combined with the fly-back transformer with an opening 4 of which one surface is open. The casing 3 has a circuit board, a slider operation member, a capacitor, a fixed resistance element and the like received therein. The circuit board is formed on a front surface thereof with a variable resistance circuit pattern. The slider operation member includes a solder arranged between the front surface of the circuit board and an inner surface of the casing, as well as an operation shaft arranged so as to project on a side of the front surface of the casing 3. The capacitor and fixed resistance element are electrically connected to the variable resistance circuit pattern. The casing 3 is integrally provided with a flange-like or plate-like terminal fitment mounting section 5 in a manner to be adjacent to one side of the opening 4. The one side of the opening 4 is a side positioned on a side on which the opening through which casting resin is cast is formed.

Figure 5:
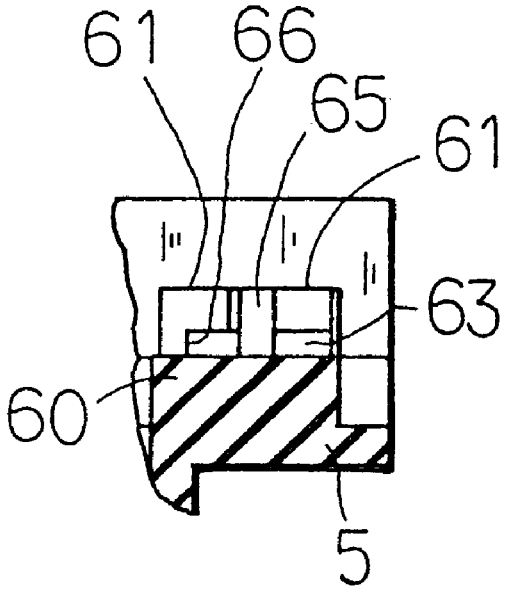
FIG. 5 is a sectional view taken along line V—V of FIG. 4A.
Figure 6:
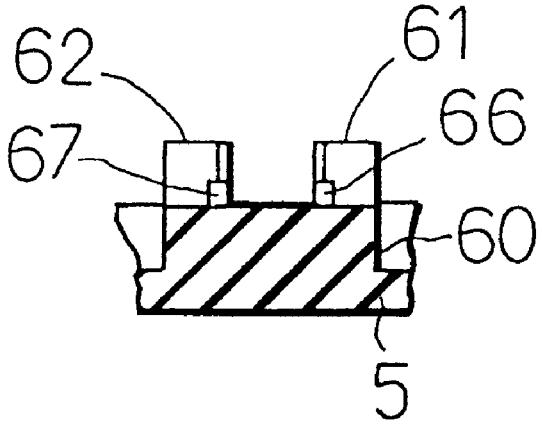
FIG. 6 is a sectional view taken along line VI—VI of FIG. 4A.

The terminal fitment mounting section 5 is integrally formed with four terminal fitment fit sections 6 and a pin terminal mounting fit section 6' in a manner to project in a direction in which the opening 4 is open. Four such terminal fitment fit sections 6 are constructed in the same manner. Now, the terminal fitment fit section 6 will be described with reference to FIGS. 4A to 6, wherein FIG. 5 is a sectional view taken along line V—V of FIG. 4A and FIG. 6 is a sectional view taken along line VI—VI of FIG. 4A. The terminal fitment fit section 6 includes a base portion 60 and a pair of raised portions 61 and 62 arranged on the base portion 60 in a manner to be spaced from each other at an interval which permits a curved section 24 of the lead wire connection terminal fitment 2 described hereinafter to pass therethrough. The raised portions 61 and 62 are formed on inner surfaces thereof opposite to each other with a pair of terminal mounting fit grooves 63 and 64, respectively. The terminal mounting fit grooves 63 and 64 each are formed so as to extend toward an inside of the casing 3 or the opening 4 from an outside of the casing 3 or an outside of the terminal fitment mounting section. Also, the raised portions 61 and 62 each are provided at an intermediate portion thereof defined in a longitudinal direction of each of the terminal mounting fit grooves 63 and 64 with a dividing groove 65 for dividing each of the terminal mounting fit grooves 63 into two parts. The terminal mounting fit grooves 63 and 64 are closed at an end thereof positioned on the inside of the casing 3 with plugs 66 and 67, respectively.

The lead wire connection terminal fitment 2, as shown in FIG. 3, is formed by subjecting a stainless steel sheet of about 0.83 mm in thickness to machining and more particularly pressing and bending. In the illustrated embodiment, the lead wire connection terminal fitment 2 has a surface subjected to plating and then solder plating. The lead wire connection terminal fitment 2, as shown in FIGS. 3A to 3C, includes a flat elongated fitted section 21 of which both ends extending in a longitudinal direction thereof are fitted in the terminal mounting fit grooves 63 and 64, a lead wire connection section 22 which is formed integrally with the fitted section 21 and to which a lead wire L (FIGS. 1A and 1B) led out of an electric component such as, for example, a capacitor C received in the casing 3 is connected, and a terminal section 23 extending outwardly of the casing 3 and electrically connected to an electric component such as, for example, an electrode provided on a circuit board on which a fly back transformer or the like arranged outside the casing 3 is mounted. The lead wire connection section 22 and fitted section 21 are connected to each other through the curved section 24 so that a right angle or a nearly right angle of, for example, about 90°±5° may be defined between the lead wire connection section 22 and the fitted section 21. The curved section 24, as shown in FIG. 3B, is formed into an L-like shape as viewed from a side and has both side ends formed into a flat shape.

The fitted section 21 of the lead wire connection terminal fitment 2 is formed on each of both ends thereof extending in the longitudinal direction thereof with a projection 25 acting as an engagement, which is engaged with a part of the terminal mounting fit section 6 to prevent the fitted section 21 from being dislocated from each of the terminal mounting fit groove 63 and 64 when both ends of the fitted section 21 are fitted in the terminal mounting fit grooves 63 and 64. The projections 25 each are provided so as to outwardly project in a width direction of the fitted section 21 and formed so as to be increased in dimension toward the terminal section 23, resulting in being provided with an inclined surface 26. In the illustrated embodiment, the projections 25 each are formed with a flat or horizontal surface on a portion thereof positioned on a side of the terminal section 23 in a manner to be contiguous to the inclined surface 26. Also, the fitted section 21 is formed on each of both ends thereof extending in the longitudinal direction thereof with a recess 27 in a manner to be contiguous to an end of the inclined surface 26 of each of the projections 25 positioned on a side of the lead wire connection section 22. The recesses 27 each have an inclined surface 28 arranged so as to be contiguous to the inclined surface 26 of the projection 25 and increased in inclined angle as compared with the inclined surface 26.

As shown in FIG. 2A, when the fitted section 21 of the lead wire connection terminal fitment 2 is fitted at both ends thereof extending in the longitudinal direction thereof in the terminal mounting fit grooves 63 and 64 and is engagedly abutted at an end 29 thereof positioned on a side of the lead wire connection section 22 and acting as a stopper against the plugs 66 and 67 for closing ends of the terminal mounting fit grooves 63 and 64, resulting in being positioned, the projections 25 provided on the fitted section 21 of the lead wire connection terminal fitment 2 are fitted in the dividing grooves 25, respectively. Then, when force in a direction toward the outside of the casing 3 from the inside thereof is applied to the lead wire connection terminal fitment 2, an end surface 25*a* of each of the projections 25 positioned on a side of the terminal section 23 is engagedly abutted against a surface 65*a* of each of the raised portion 61 and 62 defining each of the dividing grooves 65. This effectively prevents the lead wire connection terminal fitment 2 from being outwardly dislocated or removed from the casing 3 when force in a direction toward the outside of the casing 3 from the inside thereof or in a direction toward the terminal section 23 form the lead wire connection section 22 is applied to the lead wire connection terminal fitment 2.

The terminal section 23 of the lead wire connection terminal fitment 2 is preferably formed into a width or a thickness in a direction perpendicular to both a direction in which the terminal section extends and a thickness direction of the metal sheet which is equal to or larger than a thickness of the metal sheet. In the illustrated embodiment, the terminal section 23 of the lead wire connection terminal fitment 2 is formed into a width substantially equal to a thickness of the metal sheet. More specifically, the width of the terminal section 23 and the thickness of the metal sheet each are set to be about 0.83 mm. Also, in the illustrated embodiment, the fitted section 21 and terminal section 23 of the lead wire connection terminal fitment 2 are not subject to bending for reinforcement at all. It was found that mechanical strength of the terminal section 23 is substantially equal to that of a terminal section of a so-called pin terminal formed by bending a wire-like conductor of about 1 mm in diameter, irrespective of the fact that it is not subject to the bending. Thus, the terminal section 23 of the lead wire connection terminal fitment 2 may be handled or operated in substantially the same manner as the pin terminal. Also, as shown in FIG. 3C, the terminal section 23 of the lead wire connection terminal fitment 2 has four corners formed so as to extend in a direction in which the terminal section 23 extends. The corners are curved in a manner to outwardly protrude. Also, the terminal section 23 of the lead wire connection section 2 is tapered off at a distal end thereof. This permits operation of the terminal section 23 in the same manner as the pin terminal to be further ensured.

The lead wire connection section 22 includes a lead wire insertion opening 22*a* which permits a core of the lead wire L (FIG. 1) to be inserted therethrough and a lead wire press-fit groove 22*b* formed in a manner to be contiguous to the lead wire insertion opening 22*a* so that the core of the lead wire L downwardly displaced from or downwardly forced out of the lead wire insertion opening 22*a* may be press-fitted therein. The lead wire insertion opening 22*a* is enlarged in a trumpet-like manner in a direction in which the opening 4 of the casing 3 is open. In other words, the lead wire insertion opening 22*a* is formed so as to be upwardly gradually increased in width or diameter in FIG. 3C. Such configuration of the lead wire insertion opening 22*a* highly facilitates insertion of the lead wire L therethrough into the lead-wire press-fit groove 22*a*. Also, the lead wire press-fit groove 22*a* is formed on surfaces thereof opposite to each with ruggedness which is adapted to bite into the core of the lead wire L. Thus, the lead wire press-fit groove 22*b* is formed into a width smaller than a diameter of the core of the lead wire L.

In the illustrated embodiment, the lead wire connection terminal fitment 2 is arranged or mounted in such a manner that a width direction of the fitted section 21 is aligned with a longitudinal direction of the terminal fitment mounting section 5 of the casing 3. Thus, the number of lead wire connection terminal fitments 2 to be arranged is determined depending on a length of the terminal fitment mounting section 5. In FIG. 4, four such terminal fitment fit sections 6 are arranged, so that up to four such lead wire connection terminal fitments 2 may be arranged. In a high-voltage variable resistor of the double focus type, the capacitor of which one lead wire is connected to a terminal fitment (not shown) connected to two focus voltage output terminals is connected at the other lead wire to the lead wire connection terminal fitments 2 separate from each other. Also, one lead wire of a capacitor connected between an input terminal and the ground is connected to the lead wire connection terminal fitments 2 separate from each other. Connection of any lead wire to the lead wire connection terminal fitment 2 is completed by merely press-fitting the lead wire through the lead wire insertion opening 22 in the lead wire press-fit groove 22*b*. The lead wire thus press-fitted may be wound around the lead wire connection section 22.

In the illustrated embodiment, the lead wire connection terminal fitment 2 may be made of a metal sheet of 0.83 mm in thickness. Thus, use of a metal sheet of 0.7 mm or more in thickness for the lead wire connection terminal 2 permits an increase in mechanical strength of the lead wire connection terminal 2.

As can be seen from the foregoing, the lead wire connection terminal fitment may be readily mounted in the casing by merely inserting the fitted section of the lead wire connection terminal into the terminal mounting fit grooves of the casing from the outside of the casing, resulting in the mounting being automatically carried out.

Also, the present invention may be so constructed that the lead wire connection section includes the lead wire insertion opening for permitting the core of the lead wire to be inserted therethrough and the lead wire press-fit groove formed in a manner to be contiguous to the lead wire insertion opening so as to permit the lead wire displaced from the lead wire insertion opening to be pressed-fitted therein. Such construction permits fixing of the lead wire and electrical connection thereof to the terminal to be concurrently carried out by merely inserting the core of the lead wire into the lead wire insertion opening and then transferring it to the lead wire press-fit groove, so that fixing of the lead wire to the lead wire connection terminal fitment may be automatically readily attained and connection thereof to the terminal fitment may be significantly facilitated.

While a preferred embodiment of the invention has been described with a certain degree of particularity with reference to the drawings, obvious modifications and variations are possible in light of the above teachings. It is therefore to be understood that within the scope of the appended claims, the invention may be practiced otherwise than as specifically described.

What is claimed is:

1. A high-voltage variable resistor comprising:

a casing made of an insulating resin material and formed on one surface thereof with an opening;

said casing being provided on one side of said opening thereof with a terminal fitment mounting section;

said terminal fitment mounting section being provided with at least one terminal fitment fit section in a manner to be integral with said terminal fitment mounting section;

at least one capacitor received in said casing and including a lead wire;

a lead wire connection terminal fitment including a fitted section fitted in said terminal fitment fit section, a lead wire connection section which is formed integrally with said fitted section and to which said lead wire extending from said capacitor is connected, and a terminal section arranged so as to extend to an outside of said casing and electrically connected to an electric component arranged outside said casing;

said terminal fitment fit section of said terminal fitment mounting section of said casing including a pair of terminal mounting fit grooves which are formed so as to extend toward an inside of said casing from the outside thereof and in which both ends of said fitted section extending in a longitudinal direction thereof are fitted each of said terminal mounting fit grooves being closed at an end thereof facing the inside of said casing with plugs;

said fitted section of said lead wire connection terminal fitment being provided on said both ends thereof extending in said longitudinal direction thereof with an engagement;

said engagement being engaged with a part of said terminal fitment fit section to prevent said fitted section from being dislocated from each of said terminal mounting fit grooves when said both ends of said fitted section are fitted in said terminal mounting fit grooves toward the inside of said casing from the outside thereof;

said fitted section is so constructed that an end thereof defined on a side of said lead wire connection section constitutes stoppers that are abutted against said plugs provided by said terminal fitment fit section to position said fitted section when said both ends of said fitted section are inserted into said terminal mounting fit grooves toward the inside of said casing from the outside thereof;

said lead wire connection section and fitted section of said lead wire connection terminal fitment being connected to each other through a curved section so that a right angle or a nearly right angle may be defined between said lead wire connection section and said fitted section;

said lead wire connection terminal fitment being formed by subjecting a metal sheet of 0.7 mm or more in thickness to machining;

said terminal section of said lead wire connection terminal fitment having a dimension in a width direction thereof equal to or above a thickness of said metal sheet;

said lead wire connection section of said lead wire connection terminal fitment being formed with a lead wire press-fit groove in which a core of said lead wire is pressedly fitted;

said lead wire press-fit groove being formed on surfaces thereof opposite to each with ruggedness that is adapted to bite into the core of the lead wire:

said lead wire being connected to said lead wire connection section when it is kept pressedly fitted in said lead wire press-fit groove.

2. A high-voltage variable resistor as defined in claim 1, wherein said fitted section and terminal section of said lead wire connection terminal fitment are not subject to bending for reinforcement; and said terminal section is formed into a thickness and a width substantially equal to each other.

3. A high-voltage variable resistor as defined in claim 2, wherein said terminal section of said lead wire connection terminal fitment has four corners formed so as to extend in a direction in which said terminal section extends;

said corners being curved in a manner to outwardly protrude; and said terminal section of said lead wire connection section is tapered off at a distal end thereof.

4. A high-voltage variable resistor as defined in claim 1, wherein said terminal fitment fit section includes a pair of raised portions arranged in a manner to be spaced from each other at an interval which permits said curved section of said lead wire connection terminal fitment to pass therethrough;

said raised portions being formed on inner surfaces thereof opposite to each other with said terminal mounting fit grooves, respectively;

said raised portions each being provided at an intermediate portion thereof defined in a longitudinal direction of each of said terminal mounting fit grooves with a dividing groove for dividing each of said terminal mounting fit grooves Into two sections;

said fitted section of said lead wire connection terminal fitment is integrally formed on each of both ends thereof extending in the longitudinal direction thereof with a projection acting as said engagement;

said projections each being formed so as to be increased in an amount of laterally outwardly projecting from said both ends of said fitted section as they extend toward said terminal section, resulting in being provided with an inclined surface; and said fitted section is formed on each of said both ends thereof extending in the longitudinal direction thereof with a recess in a manner to be contiguous to an end of said inclined surface of each of said projections positioned on a side of said lead wire connection section;

said dividing grooves each being so formed that an end surface of each of said projections positioned on a side of said terminal section is abutted against a surface of said terminal fitment fit section defining said dividing groove when said projections each are fitted in each of said dividing grooves and force in a direction toward an outside of said casing from an inside thereof is applied to said lead wire connection terminal fitment.

* * * * *

UNITED STATES PATENT AND TRADEMARK OFFICE

CERTIFICATE OF CORRECTION

PATENT NO. : 6,206,719 B1
DATED : March 27, 2001
INVENTOR(S) : Tsunezawa et al.

It is certified that error appears in the above-identified patent and that said Letters Patent is hereby corrected as shown below:

Column 3,
Line 17, delete "μm" and insert -- mm --.

Column 5,
Line 31, before "elevational" , insert -- an --.

Column 7,
Line 31, delete "25" and insert -- 65 --.

Column 9,
Line 46, (claim 1), after "fitted", insert -- , -- (comma).

Signed and Sealed this

Eleventh Day of September, 2001

*Attest:*

Nicholas P. Godici

*Attesting Officer*

NICHOLAS P. GODICI
*Acting Director of the United States Patent and Trademark Office*